US006732802B2

(12) United States Patent
Smith

(10) Patent No.: US 6,732,802 B2
(45) Date of Patent: May 11, 2004

(54) ISOLATION BYPASS JOINT SYSTEM AND COMPLETION METHOD FOR A MULTILATERAL WELL

(75) Inventor: Ray C. Smith, Beaumont (CA)

(73) Assignee: Halliburton Energy Services, Inc., Carrollton, TX (US)

( * ) Notice: Subject to any disclaimer, the term of this patent is extended or adjusted under 35 U.S.C. 154(b) by 0 days.

(21) Appl. No.: 10/103,025

(22) Filed: Mar. 21, 2002

(65) Prior Publication Data

US 2003/0178196 A1 Sep. 25, 2003

(51) Int. Cl.[7] ..... E21B 43/12
(52) U.S. Cl. ..... 166/313; 166/285; 166/50
(58) Field of Search ..... 166/313, 50, 285, 166/287, 177.4

(56) References Cited

U.S. PATENT DOCUMENTS

| | | | | |
|---|---|---|---|---|
| 5,353,876 A | | 10/1994 | Curington et al. | |
| 5,458,209 A | | 10/1995 | Hayes et al. | |
| 5,477,925 A | | 12/1995 | Trahan et al. | |
| 5,615,740 A | | 4/1997 | Comeau et al. | |
| 5,884,704 A | * | 3/1999 | Longbottom et al. | 166/313 |
| 6,079,493 A | * | 6/2000 | Longbottom et al. | 166/313 |
| 6,079,495 A | * | 6/2000 | Ohmer | 166/313 |
| 6,089,320 A | | 7/2000 | LaGrange | |
| 6,241,021 B1 | | 6/2001 | Bowling | |
| 6,494,264 B2 | * | 12/2002 | Pringle et al. | 166/313 |

FOREIGN PATENT DOCUMENTS

| | | |
|---|---|---|
| EP | 1 249 574 A2 | 10/2002 |
| FR | 2692316 | 12/1993 |

OTHER PUBLICATIONS

Sperry–Sun Multilateral Services Profile, "LRS–SL™ Self–Locating Lateral Re–Entry System", dated 2000.

Sperry–Sun Multilateral Services Profile, "LRW–SL™ Self–Locating Lateral Re–Entry Whipstock", dated 2000.

Sperry–Sun Multilateral Services Profile, "LRS™ Lateral Re–Entry System", dated 2000.

Sperry–Sun Multilateral Services Profile, "WREAL™ Wireline Re–Entry Alignment System", dated 2000.

Sperry–Sun Multilateral Services Profile, "TEW™ Tubing Exit Whipstock", dated 2000.

Sperry–Sun Multilateral Services Profile, "LRW™ Lateral Re–Entry Whipstock", dated 2000.

Sperry–Sun Multilateral Services Profile, "TPI™ Through–Tubing Pressure Isolation Sleeve", dated 2000.

Sperry–Sun Multilateral Services Profile, "Vector Block", dated 2000.

Sperry–Sun Multilateral Services Profile, "RDS™ Re–Entry Drilling System" dated 2000.

Sperry–Sun Multilateral Services Profile, "Merlin™ Milled Exit Retrievable Multilateral System", dated 2000.

Sperry–Sun Multilateral Services Profile, "4502™ / 4503™ Metal Mill–Through Systems", dated 2000.

Sperry–Sun Multilateral Services Profile, "RMLS™ Retrievable Multilateral System", dated 2000.

(List continued on next page.)

*Primary Examiner*—David Bagnell
*Assistant Examiner*—G M Collins
(74) *Attorney, Agent, or Firm*—J. Richard Konneker; Marlin R. Smith

(57) ABSTRACT

A method of completing a subterranean well utilizes an isolation bypass transition joint at a wellbore intersection. In a described embodiment, the isolation bypass transition joint has multiple plug devices in a sidewall thereof. The transition joint extends laterally from one wellbore into another. After a cementing operation, the plug devices are opened to permit flow through the transition joint sidewall.

93 Claims, 2 Drawing Sheets

OTHER PUBLICATIONS

Sperry–Sun Multilateral Services Profile, "LTBS™ Lateral Tie–Back System", dated 2000.
Sperry–Sun Multilateral Services Profiles, "PACE–6™ Pressure–Actuated Casing Exit System", dated 2000.
Sperry–Sun Multilateral Services Profile, "Sperry–Sun Latch Coupling", dated 2000.
Sperry–Sun Multilateral Services Profile, "4501™ Low–Side Perforation System", dated 2000.
Sperry–Sun Multilateral Services Profile, "MSCS® Multi–String Completion System", dated 2000.
Sperry–Sun Multilateral Services Profile, "ITBS™ Isolated Tie–Back System", dated 2000.
Sperry–Sun Multilateral Products, Services, and Solutions, dated 2000.
Pending U.S. application: 10/122,424, filed Apr. 12, 2002, entitled Sealed Multilateral Junction System.
Pending U.S. application: 10/103,381, filed Mar. 21, 2002, entitled Downhole Tubular String Connections.
Search Report For United Kingdom Application No.: GB 0305325.3.

* cited by examiner

ISOLATION BYPASS JOINT SYSTEM AND COMPLETION METHOD FOR A MULTILATERAL WELL

BACKGROUND

The present invention relates generally to operations performed in conjunction with subterranean wells and, in an embodiment described herein, more particularly provides a method of completing a well utilizing an isolation bypass transition joint.

One method of completing a well having an intersection between a parent wellbore and a branch wellbore is to position a liner at the intersection, so that an upper end of the liner is in the parent wellbore and a lower end of the liner is in the branch wellbore. The liner may or may not be cemented in place by flowing cement about the liner at the wellbore intersection.

In transitioning laterally from the parent wellbore to the branch wellbore, the liner extends across the parent wellbore. To permit flow through the parent wellbore from below to above the wellbore intersection, a sidewall of the liner is typically perforated using conventional perforating guns equipped with a device which aims the guns to shoot through the sidewall in a desired direction. Another method is to mill through the liner sidewall using a deflection device positioned in the liner. However, the use of explosives is very hazardous and milling operations are quite time-consuming.

It would be desirable to provide an improved method which does not require the use of explosives, with their inherent dangers, and which does not require milling through the liner sidewall to provide fluid communication therethrough.

SUMMARY

In carrying out the principles of the present invention, in accordance with an embodiment thereof, a method is provided which utilizes a specially configured isolation bypass transition joint. The transition joint is used in a liner string assembly at the intersection between a parent and branch wellbore.

In one aspect of the invention, the transition joint includes two tubular strings, one inside of the other. An annular space is formed between the tubular strings. When installed at the wellbore intersection, a sidewall portion of the transition joint extends across the parent wellbore.

In another aspect of the invention, one or more plug devices are disposed in the transition joint sidewall when it is installed. The plug devices are opened to permit flow through the transition joint sidewall. The plug devices may be opened, for example, by cutting a portion of each of the devices, by dissolving a portion of each of the devices, etc.

In yet another aspect of the invention, the plug devices prevent flow through the transition joint sidewall prior to being opened. The plug devices may also isolate the annular space from the interior and exterior of the transition joint. The plug devices may continue to isolate the annular space from the interior and exterior of the transition joint after being opened.

In still another aspect of the invention, cement is flowed through the annular space, and the plug devices prevent the cement from flowing laterally out of the transition joint sidewall. After the cement has hardened, the plug devices are opened to permit flow through the transition joint sidewall. The plug devices may include generally tubular hollow portions extending from the inner tubular string to the outer tubular string.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
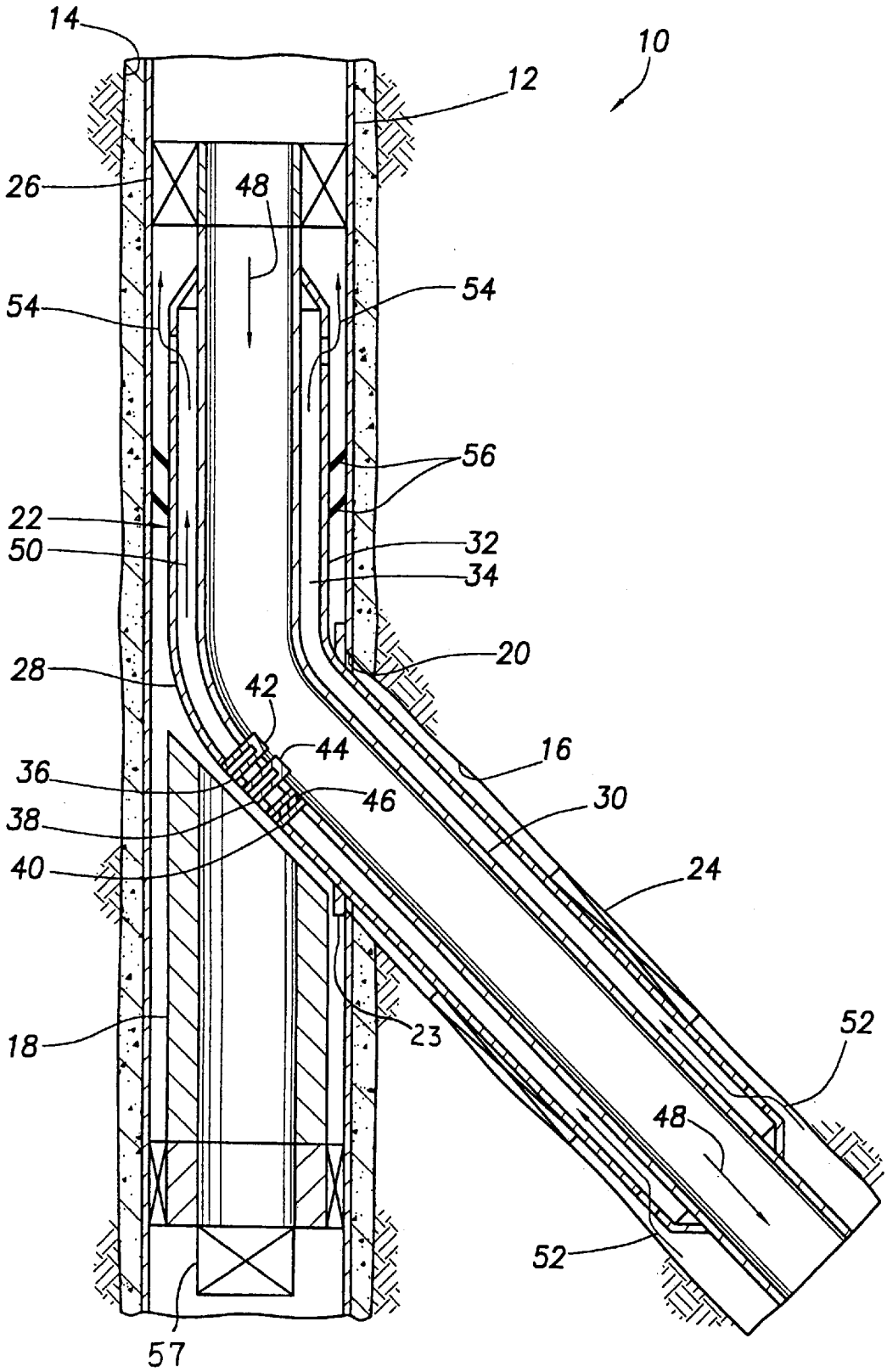
FIG. 1 is a schematic cross-sectional view of a method embodying principles of the present invention.

Representatively illustrated in FIG. 1 is a method 10 which embodies principles of the present invention. In the following description of the method 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

As depicted in FIG. 1, some steps in the method 10 have already been performed. A casing string 12 has been installed and cemented in a parent wellbore 14. A branch wellbore 16 has been drilled extending outward from the parent wellbore 14 by deflecting cutting tools, such as mills, reamers, drills, etc. off of a whipstock 18 positioned in the parent wellbore below the intersection between the parent and branch wellbores.

Mills, reamers, etc. may be deflected off of the whipstock 18 to form a window 20 laterally through the casing string 12. The window 20 could alternatively be preformed in the casing string 12. For example, the window 20 could have a relatively easily milled or drilled covering (e.g., an outer aluminum sleeve) or filling therein (e.g., a fiberglass insert) which is removed when the branch wellbore 16 is drilled.

After drilling the branch wellbore 16, a liner string assembly 22 is conveyed into the parent wellbore 14. A lower end of the assembly 22 is deflected off of the whipstock 18 and into the branch wellbore 16. A packer 24 (preferably, an inflatable packer) is set in the branch wellbore 16, and a packer/liner hanger 26 is set in the parent wellbore 14.

The packer/liner hanger 26 secures the assembly 22 in position and radially oriented as depicted in FIG. 1. However, other means may be used to position and/or orient the assembly 22. For example, an orienting latch coupling of the type well known to those skilled in the art may be installed in the casing string 12, an abutment or shoulder 23 on the assembly 22 may engage the casing at the window 20, thereby preventing further displacement of the assembly through the window, etc. As another example, a projection, shoulder, abutment or other engagement device (which may be similar in some respects to the abutment 23) may engage the whipstock 18, instead of, or in addition to, engaging the casing 12 at the window 20.

For this purpose, the whipstock 18 could include an upwardly extending tubular neck through which the assembly 22 is displaced before the whipstock deflects the lower end of the assembly into the branch wellbore 16. The abutment or shoulder 23 on the liner assembly 22 could engage this whipstock 18 upper neck to position the assembly properly with respect to the window 20 and branch wellbore 16. This engagement could also radially orient the assembly 22 relative to the whipstock 18 if the neck is provided with an orienting profile, such as an orienting latch. In addition, wireline tools, pipe tallies, pip tags, etc. may be used to determine the location of the liner assembly 22 relative to the window 20.

The abutment 23 preferably circumscribes the liner assembly 22 and extends radially outward therefrom, in the nature of a flange. This flanged abutment 23 may serve to prevent debris from the branch wellbore 16 from entering the parent wellbore 14 and accumulating about the whipstock 18, as well as serving to aid in the positioning of the liner assembly 22.

The assembly 22 includes a transition joint 28 which is positioned at the intersection between the parent and branch wellbores 14, 16. The transition joint 28 includes an inner tubular string 30 and an outer tubular string 32, with an annular space 34 formed therebetween. Several plug devices 36, 38, 40 are disposed in a sidewall of the transition joint 28 where it extends laterally across the parent wellbore 14. The plug devices 36, 38, 40 are radially oriented so that they are opposite the whipstock 18.

The plug devices 36, 38, 40 are used to selectively permit flow through the transition joint 28 sidewall. Although three of the plug devices 36, 38, 40 are depicted in FIG. 1, it is to be understood that any number of plug devices, including one, could be used.

The plug devices 36, 38, 40 are merely illustrated in FIG. 1 as examples of the wide variety of plug devices which may be used. The plug devices 36, 38, 40 could also be differently configured or positioned in the liner assembly 22 in keeping with the principles of the invention. For example, the plug devices 36, 38, 40 are oriented so that fluid flows through them in a radial direction relative to the liner assembly 22 as depicted in FIG. 1, but the plug devices could be oriented so that fluid flows through them in the same direction as fluid flow through the whipstock 18, i.e., in a vertical direction as viewed in FIG. 1.

The plug device 36 has a generally tubular and hollow body extending between the inner and outer strings 30, 32. A cap 42, which extends into the interior of the inner string 30, closes off one end of the plug device 36. When the cap 42 is cut off, the plug device 36 is opened to flow therethrough.

The plug device 38 also has a generally tubular and hollow body extending between the inner and outer strings 30, 32. A dissolvable plug 44, which extends into the interior of the inner string 30, closes off one end of the plug device 36. When the plug 44 is dissolved, the plug device 38 is opened to flow therethrough.

The plug device 40 also has a generally tubular body extending between the inner and outer strings 30, 32. However, a dissolvable plug 46 prevents fluid flow through the body of the plug device 40. When the plug 46 is dissolved, the plug device 40 is opened to flow therethrough.

Of course, many other types of plug devices could be used. For example, the entire plug device could be dissolvable, the plug device could be opened in other ways, such as by pushing the plug device through the transition joint 28 sidewall, etc. Thus, the description of the specific plug devices 36, 38, 40 in the exemplary method 10 is not to be taken as limiting the principles of the invention.

After the assembly 22 is positioned as depicted in FIG. 1, cement is flowed through the assembly. As used herein, the term "cement", "cementing", and similar terms, are used to designate any manner of securing and/or sealing a tubular string in a wellbore by flowing a hardenable substance thereabout. The substance may be cementitious, may be a hardenable gel, polymer resin, such as epoxy, etc.

The cement is flowed downwardly through the inner tubular string 30 as indicated by the arrows 48, from the parent wellbore 14 to the branch wellbore 16. The cement then flows outwardly through conventional stage cementing equipment (not shown) and upwardly between the tubular string 30 and the branch wellbore 16 as indicated by arrows 52. The arrows 52, and another arrow 50, also indicate how the cement flows upwardly in the annular space 34 between the tubular strings 30, 32 in the transition joint 28.

As the cement flows through the annular space 34, the plug devices 36, 38, 40 prevent the cement from flowing outward from the annular space, either to the interior or to the exterior of the transition joint 28. The plug devices 36, 38, 40 also prevent the cement being delivered into the branch wellbore 16 (as indicated by arrows 48) from flowing into the annular space 34, or from flowing through the plug devices to the parent wellbore 14 below the wellbore intersection.

The cement flows from the annular space 34 outwardly to an annulus between the inner string 30 and the wellbore 14 as indicated by arrows 54. From this annulus, the cement may flow upwardly through a passage in the packer/liner hanger 26 according to conventional cementing practice.

Thus, the assembly 22 is cemented in the parent and branch wellbores 14, 16 by delivering the cement through the inner string 30 and returning the cement via the annular space 34. The plug devices 36, 38, 40 facilitate this process by isolating the cement delivery and return flows, while preventing the cement from flowing into the parent wellbore 14 below its intersection with the branch wellbore 16.

Swab cups 56, or another suitable sealing device, prevent the cement returned to the annulus between the inner string 30 and the parent wellbore 14 from flowing downwardly in the parent wellbore to its intersection with the branch wellbore 16. The packer 24, or another suitable sealing device, prevents the cement flowed from the inner string 30 to the branch wellbore 16 from flowing upwardly in the branch wellbore to its intersection with the parent wellbore 14. Among other benefits, this configuration prevents the cement from flowing into or accumulating about the whipstock 18.

For well control purposes, a valve 57 may be used to selectively prevent flow through the whipstock 18. The valve 57 is preferably pressure actuated using pressure applied to the interior of the whipstock 18 after the plug devices 36, 38, 40 are opened. Pressure actuated sliding sleeve valves, pressure actuated interval control valves, and other types of conventional valves may be used for the valve 57. Of course, the valve 57 may be actuated by a means other than pressure without departing from the principles of the invention.

Figure 2:
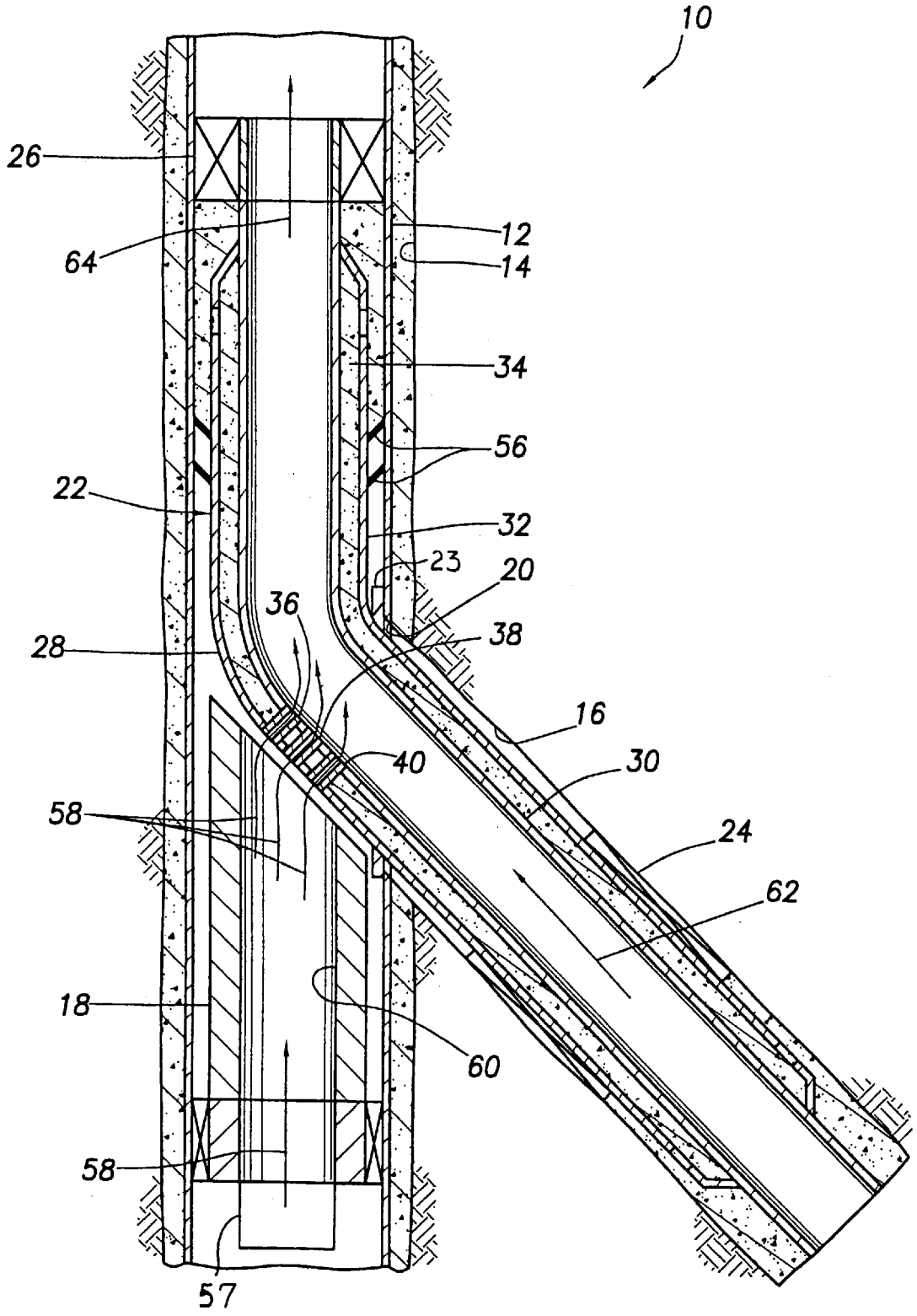
FIG. 2 is a cross-sectional view of the method of FIG. 1, wherein additional steps of the method have been performed.

Referring additionally now to FIG. 2, the method 10 is representatively illustrated after additional steps of the method have been performed. The cement flowed through the transition joint 28 has been allowed to harden. The plug devices 36, 38, 40 have been opened to thereby permit flow through the sidewall of the transition joint 28, and the valve 57 has been opened to permit flow through the whipstock 18, as indicated by arrows 58. The plug devices 36, 38, 40 and valve 57 are opened as described above.

Note that the flow 58 also passes through an internal passage 60 of the whipstock 18. Fluid communication is thus provided between the parent wellbore 14 above the wellbore intersection and the parent wellbore below the wellbore intersection. As described above, the plug devices 36, 38, 40 may be oriented so that the fluid flow 58 through the plug devices is in the same direction as flow through the passage 60.

Flow from the branch wellbore 16 (indicated by arrow 62) may commingle with the flow 58 from the lower parent wellbore 14, so that the flow into the upper parent wellbore (indicated by arrow 64) is from both the branch and lower parent wellbores. Of course, the well may be an injection well instead of a production well, in which case the above described flow directions may be reversed, and flow from or into each of the wellbores may be isolated from other wellbore fluid flows.

The plug device 36 is opened by conveying a cutting tool, such as a conventional clean-up tool used after cementing operations, or a drill, reamer, etc., into the transition joint 28 and cutting into the cap 42. Preferably, the cap 42 is completely removed, thereby completely opening the tubular body of the plug device 36 to flow therethrough. Note that, even though the plug device 36 is opened, it still isolates the annular space 34 from the interior and exterior of the transition joint 28.

The plug device 38 is opened by dissolving the plug 44 on the inner end of the plug device. This dissolving step may be performed, for example, by spotting an acid in the transition joint 28 for a time sufficient to dissolve the plug 44. A similar method may be used to dissolve the plug 46 in the tubular body of the plug device 40. Other methods of dissolving the plugs 44, 46 may be used, without departing from the principles of the invention.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A method of completing a subterranean well which includes first and second intersecting wellbores, the method comprising the steps of:

drilling the second wellbore extending outward from the first wellbore;

installing a tubular string assembly in the well so that a first portion of the assembly extends longitudinally within the first wellbore, a second portion of the assembly extends laterally across the first wellbore, and a third portion of the assembly extends longitudinally within the second wellbore;

providing at least one nonvalved plug device directly in a sidewall of the assembly second portion; and opening the plug device to thereby permit fluid communication in the first wellbore through the assembly second portion sidewall.

2. The method according to claim 1, wherein the opening step further comprises opening a hollow tubular portion of the plug device to fluid communication with an interior of the assembly second portion.

3. The method according to claim 1, further comprising the step of opening a valve device in the first wellbore.

4. The method according to claim 3, wherein the valve device opening step is performed after the plug device opening step.

5. The method according to claim 3, wherein the valve device opening step is performed by applying pressure to the valve device.

6. The method according to claim 5, wherein in the pressure applying step, the pressure is applied through the plug device.

7. The method according to claim 3, wherein in the valve device opening step, the valve device selectively permits and prevents flow through a deflection device in the first wellbore, and wherein the installing step further comprises deflecting the assembly third portion off of the deflection device into the second wellbore.

8. A method of completing a subterranean well which includes first and second intersecting wellbores, the method comprising the steps of:

drilling the second wellbore extending outward from the first wellbore;

installing a tubular string assembly in the well so that a first portion of the assembly extends longitudinally within the first wellbore, a second portion of the assembly extends laterally across the first wellbore, and a third portion of the assembly extends longitudinally within the second wellbore;

providing at least one plug device in a sidewall of the assembly second portion; and opening the plug device to thereby permit fluid communication in the first wellbore through the assembly second portion sidewall, wherein in the installing step, the assembly second portion includes a first tubular member positioned within a second tubular member, thereby forming an annular space therebetween.

9. The method according to claim 8, wherein in the providing step, the plug device extends across the annular space between the first and second tubular members.

10. The method according to claim 8, wherein in the opening step, the open plug device isolates the annular space from an interior of the assembly second portion.

11. The method according to claim 8, wherein in the opening step, the open plug device isolates the annular space from the first wellbore external to the assembly second portion.

12. The method according to claim 8, further comprising the step of flowing cement through the annular space.

13. A method of completing a subterranean well which includes first and second intersecting wellbores, the method comprising the steps of:

drilling the second wellbore extending outward from the first wellbore;

installing a tubular string assembly in the well so that a first portion of the assembly extends longitudinally within the first wellbore, a second portion of the assembly extends laterally across the first wellbore, and a third portion of the assembly extends longitudinally within the second wellbore;

providing at least one plug device in a sidewall of the assembly second portion; and opening the plug device to thereby permit fluid communication in the first wellbore through the assembly second portion sidewall, wherein the opening step further comprises cutting off a portion of the plug device extending into an interior of the assembly second portion.

14. A method of completing a subterranean well which includes first and second intersecting wellbores, the method comprising the steps of:

drilling the second wellbore extending outward from the first wellbore;

installing a tubular string assembly in the well so that a first portion of the assembly extends longitudinally within the first wellbore, a second portion of the assembly extends laterally across the first wellbore, and a third portion of the assembly extends longitudinally within the second wellbore;

providing at least one plug device in a sidewall of the assembly second portion; and opening the plug device to thereby permit fluid communication in the first wellbore through the assembly second portion sidewall, wherein the opening step further comprises dissolving a portion of the plug device.

15. The method according to claim 14, wherein in the opening step, the plug device portion extends into an interior of the assembly second portion.

16. The method according to claim 14, wherein in the opening step, the plug device portion prevents flow through a passage of the plug device extending through the assembly second portion sidewall.

17. A method of completing a subterranean well which includes first and second intersecting wellbores, the method comprising the steps of:

drilling the second wellbore extending outward from the first wellbore;

installing a tubular string assembly in the well so that a first portion of the assembly extends longitudinally within the first wellbore, a second portion of the assembly extends laterally across the first wellbore, and a third portion of the assembly extends longitudinally within the second wellbore;

providing at least one plug device in a sidewall of the assembly second portion;

opening the plug device to thereby permit fluid communication in the first wellbore through the assembly second portion sidewall; and flowing cement through the tubular string assembly and into the first and second wellbores, a first sealing device providing sealing engagement between the assembly first portion and the first wellbore, a second sealing device providing sealing engagement between the assembly third portion and the second wellbore.

18. The method according to claim 17, wherein in the cement flowing step, the first and second sealing devices isolate an intersection between the first and second wellbores from the cement flow.

19. The method according to claim 17, wherein in the cement flowing step, the first and second sealing devices isolate a deflection device in the first wellbore from the cement flow.

20. A method of completing a subterranean well which includes first and second intersecting wellbores, the method comprising the steps of:

drilling the second wellbore extending outward from the first wellbore;

installing a tubular string assembly in the well so that a first portion of the assembly extends longitudinally within the first wellbore, a second portion of the assembly extends laterally across the first wellbore, and a third portion of the assembly extends longitudinally within the second wellbore;

providing at least one plug device in a sidewall of the assembly second portion; and opening the plug device to thereby permit fluid communication in the first wellbore through the assembly second portion sidewall, wherein the installing step further comprises engaging a positioning device on the assembly to thereby locate the assembly relative to the first wellbore.

21. The method according to claim 20, wherein the engaging step further comprises radially orienting the assembly relative to the first wellbore.

22. The method according to claim 21, wherein the radially orienting step further comprises aligning the plug device with a flow passage through a deflection device in the first wellbore.

23. The method according to claim 20, wherein the engaging step further comprises engaging the positioning device with a window formed between the first and second wellbores.

24. The method according to claim 23, wherein the engaging step further comprises engaging the positioning device circumscribing the window, so that debris is prevented from passing between the first and second wellbores.

25. The method according to claim 20, wherein the engaging step further comprises engaging a deflection device in the first wellbore.

26. A method of completing a subterranean well which includes first and second intersecting wellbores, the method comprising the steps of:

drilling the second wellbore extending outward from the first wellbore;

installing a tubular string assembly in the well so that a first portion of the assembly extends longitudinally within the first wellbore, a second portion of the assembly extends laterally across the first wellbore, and a third portion of the assembly extends longitudinally within the second wellbore;

flowing cement through an annular space formed between first and second tubular strings of a sidewall of the assembly second portion; and preventing the cement from flowing laterally out of the sidewall using at least one plug device in the sidewall.

27. The method according to claim 26, further comprising the step of opening the plug device, thereby permitting fluid flow through the sidewall.

28. The method according to claim 27, wherein the opening step is performed after the cement has hardened in the annular space.

29. The method according to claim 27, wherein the opening step further comprises cutting a portion of the plug device.

30. The method according to claim 27, wherein the opening step further comprises dissolving a portion of the plug device.

31. The method according to claim 26, wherein the flowing step further comprises flowing the cement from a first annulus formed between the first tubular string and the second wellbore to a second annulus formed between the first tubular string and the first wellbore.

32. The method according to claim 26, wherein the flowing step further comprises isolating the cement from an annulus formed between the assembly second portion and an intersection between the first and second wellbores.

33. The method according to claim 32, wherein the isolating step further comprises using the plug device to isolate an interior of the assembly second portion from the annulus.

34. The method according to claim 33, wherein the flowing step further comprises delivering the cement from the first wellbore to the second wellbore via the assembly second portion interior, and returning the cement via the annular space.

35. The method according to claim 26, wherein the cement flowing step further comprises flowing cement through the tubular string assembly and into the first and second wellbores, a first sealing device providing sealing engagement between the assembly first portion and the first wellbore, a second sealing device providing sealing engagement between the assembly third portion and the second wellbore.

36. The method according to claim 35, wherein in the cement flowing step, the first and second sealing devices isolate an intersection between the first and second wellbores from the cement flow.

37. The method according to claim 35, wherein in the cement flowing step, the first and second sealing devices isolate a deflection device in the first wellbore from the cement flow.

38. The method according to claim 26, further comprising the step of opening a valve device in the first wellbore.

39. The method according to claim 38, further comprising the step of opening the plug device, and wherein the valve device opening step is performed after the plug device opening step.

40. The method according to claim 38, wherein the valve device opening step is performed by applying pressure to the valve device.

41. The method according to claim 40, wherein in the pressure applying step, the pressure is applied through the plug device.

42. The method according to claim 38, wherein in the valve device opening step, the valve device selectively permits and prevents flow through a deflection device in the first wellbore, and wherein the installing step further comprises deflecting the assembly third portion off of the deflection device into the second wellbore.

43. The method according to claim 26, wherein the installing step further comprises engaging a positioning device on the assembly to thereby locate the assembly relative to the first wellbore.

44. The method according to claim 43, wherein the engaging step further comprises radially orienting the assembly relative to the first wellbore.

45. The method according to claim 44, wherein the radially orienting step further comprises aligning the plug device with a flow passage through a deflection device in the first wellbore.

46. The method according to claim 43, wherein the engaging step further comprises engaging the positioning device with a window formed between the first and second wellbores.

47. The method according to claim 46, wherein the engaging step further comprises engaging the positioning device circumscribing the window, so that debris is prevented from passing between the first and second wellbores.

48. The method according to claim 43, wherein the engaging step further comprises engaging a deflection device in the first wellbore.

49. A method of completing a subterranean well which includes first and second intersecting wellbores, the method comprising the steps of:

drilling the second wellbore extending outward from the first wellbore;

installing a tubular string assembly in the well so that a first portion of the assembly extends longitudinally within the first wellbore, a second portion of the assembly extends laterally across the first wellbore, and a third portion of the assembly extends longitudinally within the second wellbore;

then flowing cement through an annular space between first and second tubular strings of the assembly second portion; and then opening at least one plug device in a sidewall of the assembly second portion, thereby permitting flow through the first wellbore via the open plug device.

50. The method according to claim 49, wherein the opening step further comprises permitting flow between an interior of the assembly second portion and an annulus formed between the assembly second portion and an intersection of the first and second wellbores.

51. The method according to claim 49, wherein in the opening step, the open plug device isolates the annular space from an interior of the assembly second portion.

52. The method according to claim 49, wherein in the opening step, the open plug device isolates the annular space from the first wellbore external to the assembly second portion.

53. The method according to claim 49, wherein the opening step further comprises cutting a portion of the plug device.

54. The method according to claim 53, wherein the plug device portion extends into an interior of the assembly second portion.

55. The method according to claim 49, wherein the opening step further comprises opening a hollow tubular portion of the plug device to fluid communication with an interior of the assembly second portion.

56. The method according to claim 49, wherein the opening step further comprises dissolving a portion of the plug device.

57. The method according to claim 56, wherein the plug device portion extends inwardly into an interior of the assembly second portion.

58. The method according to claim 56, wherein in the opening step, the plug device portion prevents flow through a passage of the plug device extending through the assembly second portion sidewall.

59. The method according to claim 49, wherein the opening step is performed after the cement has hardened in the annular space.

60. The method according to claim 49, wherein the flowing step further flowing the cement from a first annulus formed between the first tubular string and the second wellbore to a second annulus formed between the first tubular string and the first wellbore.

61. The method according to claim 49, wherein the flowing step further comprises isolating the cement from an annulus formed between the assembly second portion and an intersection between the first and second wellbores.

62. The method according to claim 61, wherein the isolating step further comprises using the plug device to isolate an interior of the assembly second portion from the annulus.

63. The method according to claim 62, wherein the flowing step further comprises delivering the cement from the first wellbore to the second wellbore via the assembly second portion interior, and returning the cement via the annular space.

64. The method according to claim 49, wherein the cement flowing step further comprises flowing cement through the tubular string assembly and into the first and second wellbores, a first sealing device providing sealing engagement between the assembly first portion and the first wellbore, a second sealing device providing sealing engagement between the assembly third portion and the second wellbore.

65. The method according to claim 64, wherein in the cement flowing step, the first and second sealing devices isolate an intersection between the first and second wellbores from the cement flow.

66. The method according to claim 64, wherein in the cement flowing step, the first and second sealing devices isolate a deflection device in the first wellbore from the cement flow.

67. The method according to claim 49, further comprising the step of opening a valve device in the first wellbore.

68. The method according to claim 67, wherein the valve device opening step is performed after the plug device opening step.

69. The method according to claim 67, wherein the valve device opening step is performed by applying pressure to the valve device.

70. The method according to claim 69, wherein in the pressure applying step, the pressure is applied through the plug device.

71. The method according to claim 67, wherein in the valve device opening step, the valve device selectively permits and prevents flow through a deflection device in the first wellbore, and wherein the installing step further comprises deflecting the assembly third portion off of the deflection device into the second wellbore.

72. The method according to claim 49, wherein the installing step further comprises engaging a positioning device on the assembly to thereby locate the assembly relative to the first wellbore.

73. The method according to claim 72, wherein the engaging step further comprises radially orienting the assembly relative to the first wellbore.

74. The method according to claim 73, wherein the radially orienting step further comprises aligning the plug device with a flow passage through a deflection device in the first wellbore.

75. The method according to claim 72, wherein the engaging step further comprises engaging the positioning device with a window formed between the first and second wellbores.

76. The method according to claim 75, wherein the engaging step further comprises engaging the positioning device circumscribing the window, so that debris is prevented from passing between the first and second wellbores.

77. The method according to claim 72, wherein the engaging step further comprises engaging a deflection device in the first wellbore.

78. A system for flowing cement through an intersection formed between first and second wellbores, the second wellbore extending outwardly from the first wellbore, while isolating the wellbore intersection from the cement flow, the system comprising:

a tubular string assembly positioned in the well so that a first portion of the assembly extends longitudinally within the first wellbore, a second portion of the assembly extends laterally across the first wellbore, and a third portion of the assembly extends longitudinally within the second wellbore, the assembly including inner and outer tubular strings;

a first sealing device sealing across a first annulus between the assembly first portion and the first wellbore; and a second sealing device sealing across a second annulus between the assembly third portion and the second wellbore.

79. The system according to claim 78, wherein the first and second sealing devices isolate the wellbore intersection from cement flowing through the assembly between the first and second wellbores.

80. The system according to claim 78, further comprising at least one plug device preventing flow through a sidewall of the assembly, the plug device being opened to permit flow in the first wellbore through the assembly sidewall.

81. The system according to claim 80, wherein the plug device isolates the wellbore intersection from cement flowing through the assembly between the first and second wellbores.

82. The system according to claim 78, wherein the cement flows from the first wellbore to the second wellbore through the first tubular string, and wherein the cement flows from the second wellbore to the first wellbore through a third annulus between the first and second tubular strings.

83. The system according to claim 82, further comprising at least one plug device preventing flow through a sidewall of the assembly, the plug device isolating cement flow in the third annulus from the wellbore intersection.

84. The system according to claim 78, further comprising a valve device in the first wellbore selectively isolating a portion of the first wellbore from the assembly second portion.

85. The system according to claim 84, wherein the valve device is actuated by pressure applied to the valve device.

86. The system according to claim 84, wherein the valve device is actuated by pressure applied through a plug device selectively preventing fluid flow through a sidewall of the assembly.

87. The system according to claim 84, wherein the valve device selectively permits and prevents flow through a deflection device in the first wellbore used to deflect the assembly third portion into the second wellbore.

88. The system according to claim 78, wherein a positioning device on the assembly locates the assembly relative to the first wellbore.

89. The system according to claim 88, wherein the positioning device further radially orients the assembly relative to the first wellbore.

90. The system according to claim 88, wherein the positioning device radially orients a plug device of the assembly with a flow passage through a deflection device in the first wellbore.

91. The system according to claim 88, wherein the positioning device is engaged with a window formed between the first and second wellbores.

92. The system according to claim 91, wherein the positioning device circumscribes the window, so that debris is prevented from passing between the first and second wellbores.

93. The system according to claim 88, wherein the positioning device engages a deflection device in the first wellbore.

* * * * *